United States Patent [19]

Hosaka et al.

[11] 4,313,412

[45] Feb. 2, 1982

[54] FUEL SUPPLY CONTROL SYSTEM

[75] Inventors: Akio Hosaka, Yokohama; Masaharu Asano, Yokosuka, both of Japan

[73] Assignee: Nissan Motor Company Limited, Yokohama, Japan

[21] Appl. No.: 131,094

[22] Filed: Mar. 18, 1980

[30] Foreign Application Priority Data

Mar. 19, 1979 [JP] Japan ..... 54-31191

[51] Int. Cl.[3] ..... F02B 3/00

[52] U.S. Cl. ..... 123/480; 123/486

[58] Field of Search ..... 123/480, 486, 438, 440

[56] References Cited

U.S. PATENT DOCUMENTS

| | | | |
|---|---|---|---|
| 3,835,819 | 9/1974 | Anderson | 123/480 |
| 3,862,404 | 1/1975 | Fiedrich | 123/480 |
| 4,107,717 | 8/1978 | Klotzner | 123/480 |
| 4,212,066 | 7/1980 | Carp | 123/480 |
| 4,214,306 | 7/1980 | Kobayashi | 123/480 |
| 4,214,307 | 7/1980 | Peterson | 123/480 |
| 4,240,390 | 12/1980 | Takeda | 123/480 |

*Primary Examiner*—Ronald B. Cox

*Attorney, Agent, or Firm*—Schwartz, Jeffery, Schwaab, Mack, Blumenthal & Koch

[57] ABSTRACT

A fuel supply control system is disclosed which uses a stored program type digital computer for calculating a basic amount of fuel and modifying the basic amount in accordance with various correction factors dependent upon engine operating conditions so as to determine an actual amount of fuel supplied to an engine. The actual fuel amount is determined by adding all correction factors dependent upon engine temperature and multiplying the sum by the basic fuel amount.

7 Claims, 8 Drawing Figures

FUEL SUPPLY CONTROL SYSTEM

BACKGROUND OF THE INVENTION

1. Field of the Invention

This invention relates to a fuel supply control system for use in internal combustion engine such as gasoline engines, diesel engines, or the like and, more particularly, to such a fuel supply control system utilizing a digital computer for determining an optimum pulse width of fuel injection pulses to control the duration of opening of fuel injection valve means.

2. Description of the Prior Art

Conventional electronic fuel injection control systems first determine a basic fuel injection signal pulse width Tp by deriving an air flow rate per engine rotation Q/N from the intake air flow rate Q measured with the use of an air flow meter and the engine rotational speed N detected in accordance with an ignition pulse signal or any other suitable signal proportional to engine rotational speed and multiplying the obtained value Q/N by a constant K and then calculate an effective fuel injection signal pulse width Te by performing an arithmetical operation expressed by the following equation:

$$Te=\tfrac{1}{2}\cdot Tp\cdot[1+(1+2W)\{1+2(S+R+D+F)\}] \quad (1)$$

wherein W is the correction factor determined by engine coolant temperature, S is the correction factor required during engine starting, R is the correction factor required in acceleration, D is the correction factor required in deceleration, and F is the correction factor required at high load conditions.

The resulting effective fuel injection signal pulse width Te may be modified in accordance with an air/fuel ratio control signal from an exhaust gas sensor and a correction factor determined by the voltage of a battery, and with the use of another arithmetical equation if associated with fuel-cut controller to cut fuel to the engine during deceleration.

It can be seen from equation (1) that the fuel injection control system is required to carry out a number of multiplications (6 multiplications including the multiplication of the constant K). Although such a calculation can be made with a relatively small delay so as not to arise any problem with the use of a wired logic computer adapted to perform multiplications concurrently, a long run time is required with the use of a stored program computer adapted to perform arithmetical operations with time sharing. Most of currently available microcomputers have no multiplier and require much time to perform multiplications. For example, the Motorola Inc., Model MC 6800 8-bit microcomputer requires about 200 μs for a multiplication of 8-bits by 8-bits and about 800 μs for a multiplication of 16-bits by 16-bits. Therefore, 1.2 to 4.8 ms is required for such 6 multiplications.

Recently, improved microcomputers have been developed which are endowed with improved multiplying performance to reduce the run time of multiplications. However, they are expensive and require a spaceconsuming IC. Additionally, they required much time to perform multiplications as compared with addition and substruct operations.

There is the possibility of increasing the speed of rotation of an engine near 7,000 to 8,000 rpm. If the engine is rotating at 8,000 rpm, it takes 7.5 ms for each rotation of the engine. Such fuel is injected in synchronism with rotation of the engine, a calculation is required within 7.5 ms. In view of this, the run time of 1.2 to 4.8 ms is too long. The control system performs other arithmetical operations other than multiplication and thus it is undesirable that much time is wasted for such multiplications. Furthermore, in case where spark timing control, exhaust gas recirculation rate control and other controls are performed simultaneously in a single microcomputer, the operations of the microcomputer is very complex and it is necessary to reduce the time required to perform such multiplications. In addition, it is desirable to reduce the time required for such calculations as small as possible so as to control the engine with new data and without less delay although much time is allowed for calculations if the engine is rotating at low speeds. Accordingly, the conventional equation is not suitable for electronic controlled fuel supply systems using a digital computer.

As can be seen by a study of equation (1), the various correction factors S, R, D and F are multiplied by the correction term (1+2W). The various correction factors are dependent upon coolant temperature and the term (1+2W) is not always suitable for them. The various correction factors should be set as a function of coolant temperature. Accordingly, complex and time-consuming operations are required to provide an optimum pulse width of fuel injection signal in case where equation (1) is adopted to various types of automotive vehicle and engine.

SUMMARY OF THE INVENTION

It is therefore one object of the present invention to provide an improved fuel supply control system using a digital computer which is free from the above described desadvantages found in conventional ones.

Another object of the present invention is to provide an improved fuel supply control system with a fast response to variations in engine operating condition.

Still another object of the present invention is to provide an improved fuel supply control system which can improve engine performance and fuel economy.

According to the present invention, the digital computer is adapted to carry out an arithmetical operation expressed by the following equation:

$$Te=Tp\cdot(1+Kw+Ks+Kr+Kd+Kf)$$

wherein Te is the actual pulse width, Tp is the basic pulse width, Kw is the correction factor determined by engine coolant temperature, Ks is the correction factor required during engine starting, Kr is the correction factor required in acceleration, Kd is the correction factor required in deceleration, and Kf is the correction factor required at high load conditions.

This permits reduction of the number of multiplications required for determination of the pulse width of fuel injection signal, the run time of the calculation. The correction factors Ks, Kr, Kd and Kf can be set independently of the correction factor Kw.

BRIEF DESCRIPTION OF THE DRAWINGS

For a better understanding of the invention, as well as other objects and further feature thereof, reference is made to the following detailed description of the invention to be read in connection with the accompanying drawings, wherein.

DESCRIPTION OF THE PREFERRED EMBODIMENTS

Figure 1:
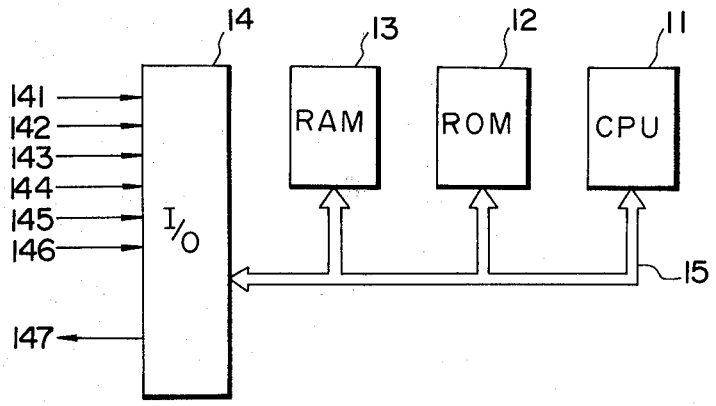
FIG. 1 is a block diagram showing one embodiment of the present invention.

Referring first to FIG. 1, the fuel injection control system, employing the present invention, includes a central processing unit (CPU) 11, a read only memory (ROM) 12, a random access memory (RAM) 13, an input-output device (I/O) 14, and bus lines 15. The input-output device 14 is supplied through a line 141 with clock pulses generated in synchronism with rotation of an engine for use in accomplishing timing of the start of fuel injection and synchronizing the operations carried out in the system. Pulses generated at a frequency proportional to the speed of rotation of the engine are applied through a line 142 to the input-output device 14 which counts the number of the pulses to provide a data indicative of the engine rotational speed N. The pulse signals fed to the input-output device 14 through the lines 141 and 142 may be generated by means including rotary members mechanically coupled to the crankshaft of the engine. An analog signal inversely proportional to the intake air flow rate is applied through a line 143 to the input-output device 14 which converts it into a digital data indicative of the reciprocal 1/Q of the intake air flow rate Q. The input-output device 14 also receives an analog signal through a line 144 from a temperature sensor such as a thermistor or the like sensing the temperature of engine coolant and converts it into a digital data indicative of the engine temperature Tw. In addition, the input-output device 14 receives a signal through a line 145 from a starter switch (not shown) and a signal through a line 146 from a throttle switch (not shown) adapted to actuate near the closed position of the throttle valve. The input-output device 14 outputs through a line 147 a fuel injection pulse signal for driving fuel injection valve means.

The CPU 11 runs, in accordance with the program and data stored in the ROM 12, to read the inputted data out of the input-output device 14, perform an arithmetical operation expressed by an equation to be described later so as to determine the pulse width of the fuel injection pulse signal, and set the obtained value in the input-output device 14. In synchronism with the arrival of the clock pulses, the input-output device 14 generates fuel injection pulses of a pulse width corresponding to the valve set therein to the fuel injection valve means. The data to be used during the arithmetical operation and the inputted data are temporarily stored in the RAM 13 and read by the CPU 11. The system includes control means such as a constant-voltage regulated power supply, reset circuit, crystal oscillator, interrupt signal generating timer circuit, or the like.

Figure 2:
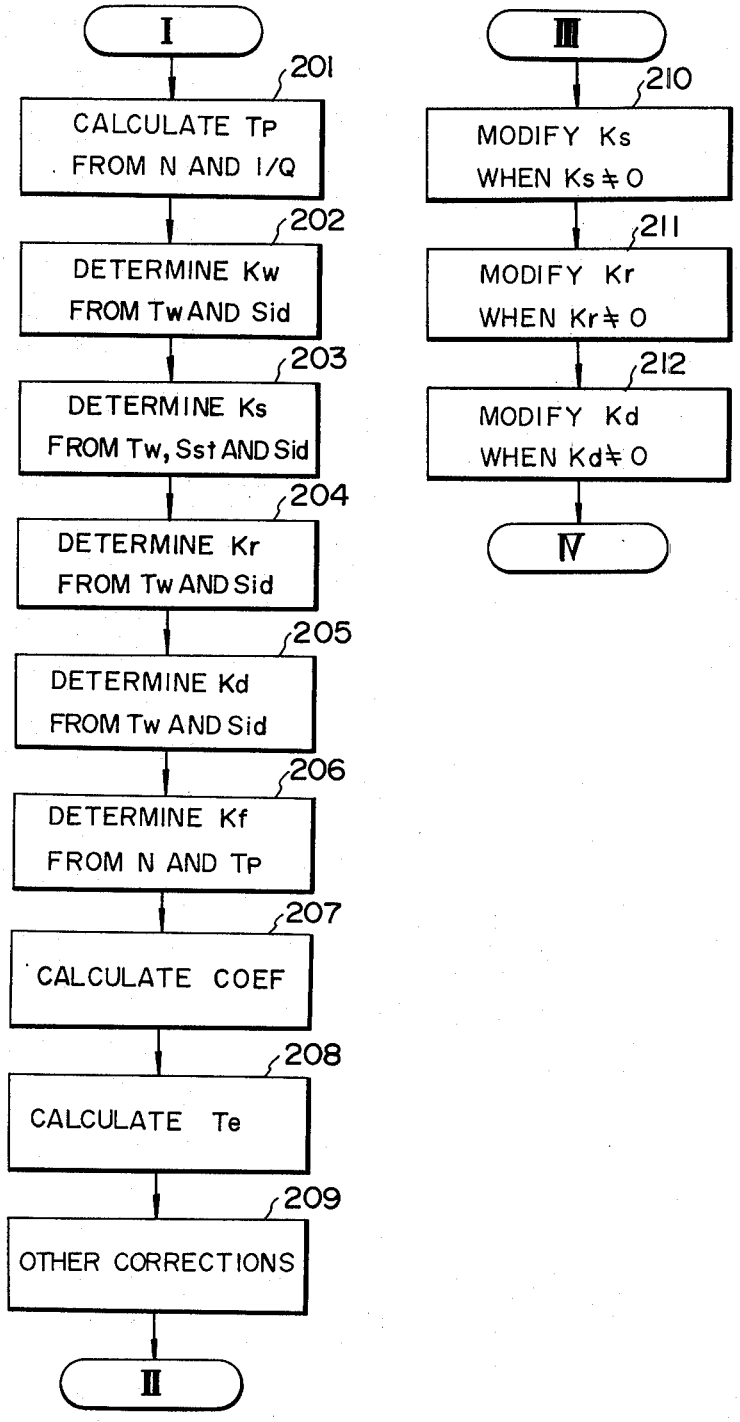
FIGS. 2 and 3 are flowcharts used in explaining the operation of the present invention.

FIG. 2 is a flowchart showing successive steps included in the process of effective pulse width determination embodying the present invention. The left-hand or first program starts at I and terminates at II, and the right-hand or second program starts at III and terminates at IV. The first program may be carried out in each cycle determined by the run duration required for all of the programs (in which case the end II is connected directly or through any other suitable program to the start I), each time a constant time is elapsed (in which case the program is started in synchronism with the arrival of an interrupt signal coming with the lapse of a constant time and another program (not shown) is carried out after the termination of the program), or after the termination of another program (in which case the program is carried out subsequently with the termination of, for example, an input signal reading program (not shown) and another program is carried out after the termination of the program).

The first program starting at I includes a block 201 to calculate a basic pulse width Tp using the engine speed N and the reciprocal 1/Q of the intake air flow rate Q, a block 202 to calculate a correction factor Kw determined by engine coolant temperature from the engine coolant temperature Tw and the signal Sid from the idle switch, a block 203 to calculate the initial value of the correction factor Ks required during engine starting from the engine coolant temperature Tw and the signal Sst from the starter switch, block 204 to calculate the initial value of the correction factor Kr required during acceleration from the engine coolant temperature Tw and the signal Sid, a block 206 to calculate a correction factor Kf required at high load conditions from the engine speed N and the basic pulse width Tp, a block 207 to calculate a correction coefficient COEF by adding 1, Kw, Ks, Kr, Kd and Kf, and block 208 to calculate an effective pulse width Te by multiplying the basic pulse width Tp by the correction coefficient COEF, and a block 209 to correcting the effective pulse width Te in accordance with any other suitable correction factor to determine an output pulse width Ti which is outputted to the input-output device 14.

The initial values Ks, Kr and Kd determined respectively in the blocks 203 to 205 are adjusted in accordance with engine rotational number accumulated value with the second program which starts in accordance with the arrival of a rotation interrupt signal in synchronism with rotation of the engine.

Figure 3:
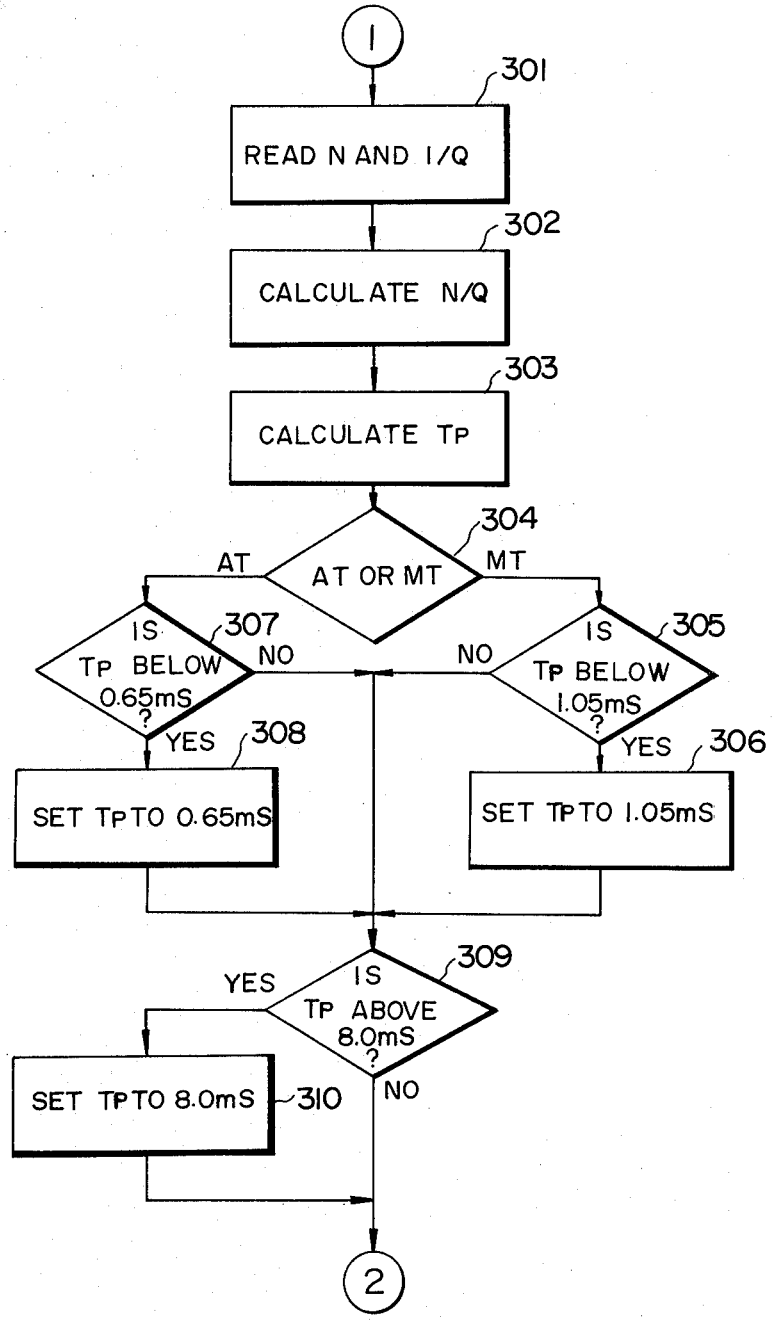

FIG. 3 is a flowchart showing the successive steps including in the process of basic pulse width calculation corresponding to the block 201 of FIG. 2. The program starts at 1 and includes a block 301 to read the signals indicative of the engine rotational speed N and the reciprocal 1/Q of the intake air flow rate Q, a block 302 to multiplying the engine rotational speed N by the reciprocal 1/Q to obtain N/Q, and a block 303 to divide a constant K by the value N/Q to obtain a basic pulse width $Tp=K\cdot(Q/N)$. Before the division, division overflow should be tested.

Upon basic pulse width calculation, it should be taken into a consideration that the air flow meter, which is designed to have such a high responsibility as to follow rapid variations in intake air flow rate, tends to overshoot or undershoot, resulting in an overshoot or undershoot basic pulse width value when subjected to stepped variations in intake air flow rate. This produces overrich or overlean mixture, causing spoiled exhaust gas purifying performance, spoiled engine performance, and engine stalling. In order to avoid such over- and undershooting of the basic pulse width value, it is desirable to limit the uppermost and lowermost values of the calculated basic pulse width Tp.

For this purpose, after testing in a block 304 whether the automotive vehicle is installed with an automatic or manual transmission, the calculated basic pulse width Tp is compared with a lower limit 0.65 ms in a block 307 if the transmission is of the automatic type and with a lower limit 1.05 ms in a block 305 if the transmission is of the manual type. The reason of the difference between the lower limits depending on the type of the transmission installed in the automotive vehicle is that unlike automatic transmission installed ones, manual transmission installed automotive vehicles have an axle directly coupled to the engine so that the axle drives the engine to reduce the possibility of occurrence of engine stalling during deceleration, and that from the fuel economy standpoint, it is desirable to set the lower limit as low as possible.

If the calculated basic pulse width Tp is above the lower limit, it is set to 0.65 ms in a block 308 for an automatic transmission installed vehicle and to 1.05 ms in a block 306 for a manual transmission installed vehicle. Otherwise, the calculated basic pulse width Tp is compared with an upper limit, for example, 0.8 ms. If the calculated basic pulse width Tp is above the upper limit, it is set to 8.0 ms.

It is to be noted that the upper limit may be predetermined separately for automatic and manual transmission installed automotive vehicles. Additionally, it is to be noted that in order to avoid over- and undershooting of the basic pulse width Tp, the reciprocal 1/Q of the intake air flow rate Q or the produce N/Q of the engine speed N and the reciprocal 1/Q may be limited in a manner similar to that described in connection with the limitation of the basic pulse width Tp.

Figure 4:
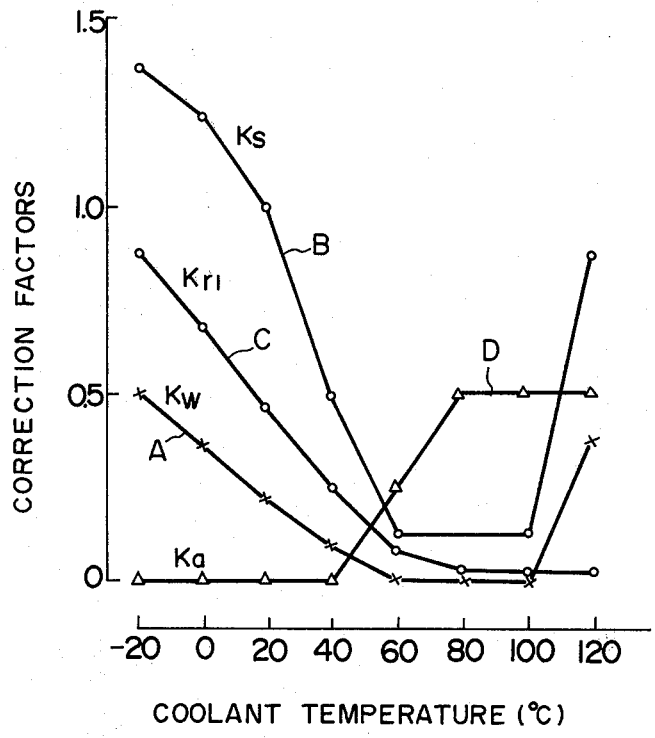
FIG. 4 is a graph plotting various correction factors with respect to given engine coolant temperatures.

FIG. 4 is a graph plotting various correction factors with respect to given engine coolant temperatures. Curve A illustrates variations in the correction factor Kw determined by the engine coolant temperature. Curve B illustrates variations in the correction factor Ks required during engine starting, curve C variations in the correction factor Kr1 required in acceleration, and curve D variations in the correction factor Kd required in deceleration.

The process of the determination of the correction factor Kw is performed by looking up values arranged in a table correspondingly to given coolant temperature values. Simplification of the table can be made by arranging correction factor values with a large space and applying interpolation to determined an intermediate value.

The coolant temperature indicative signal is a digital signal converted from an analog voltage signal resulting from variations in the resistance of the thermistor as previously stated. Since the relationship between the coolant temperature indicative digital signal and engine coolant temperature is not always linear, it is preferable to obtain a required engine coolant temperature value by a look-up technique retrieving it from a table in relation to the digital signal. Of course, the digital signal may be used directly as a required coolant temperature value if a substantially linear relationship is established between the coolant temperature indicative digital signal and coolant temperature.

Figure 5:
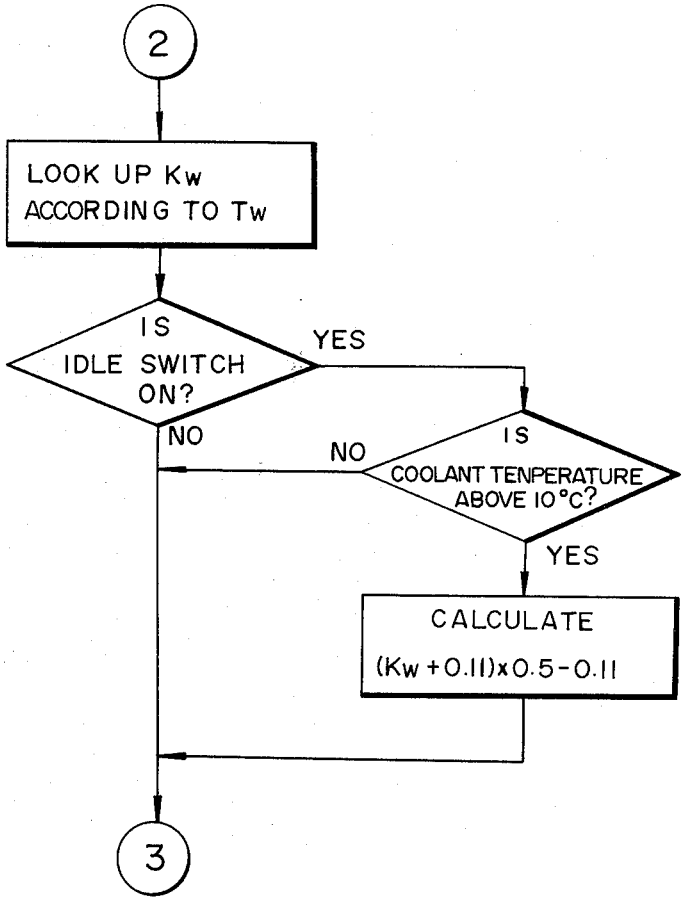
FIGS. 5 to 8 are flowcharts used to explain the operation of the present invention.

It is desirable to change the correction factor Kw depending on the state of the idle switch since during idling where the coolant temperature is relatively high and the engine load is relatively low, a small value of correction factor Kw arises no problem and is preferable from the fuel economy standpoint. For this purpose, the CPU enters a program as shown in FIG. 5, which corresponds to the block 202 of FIG. 2 and is subsequent to the end of the program of FIG. 3. If the idle switch is ON and the coolant temperature is above 10° C., the correction factor Kw is reduced by a look-up technique or by a calculation according to an experimental equation as shown in FIG. 5. If the result from the calculation is negative, the correction factor Kw is set to zero. The experimental equation may be modified for other types of engines.

Figure 6:
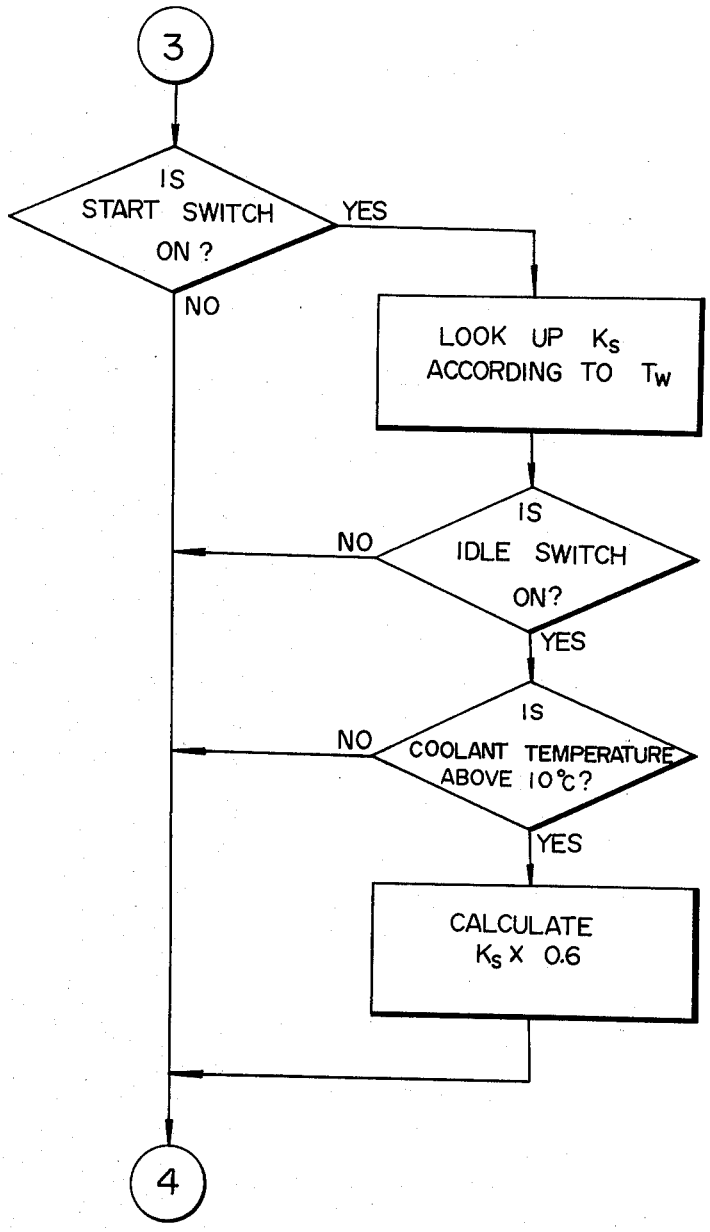
Figure 7:
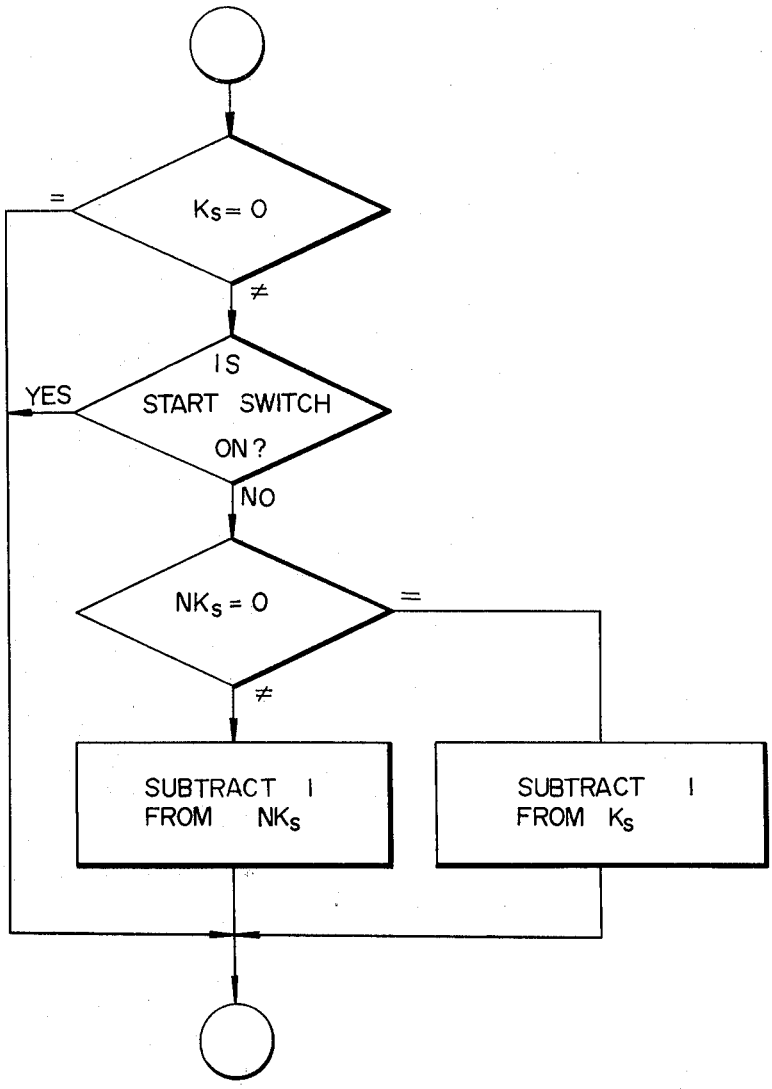

The correction factor Ks is for improving engine starting performance during engine starting and stabilizing engine performance after cranking. The correction factor Ks is determined in accordance with a program as shown in FIG. 6 which corresponds to the block 203 of FIG. 2 and is subsequent to the end of the program of FIG. 6 and a program as shown in FIG. 6 which corresponds to the block 210 of FIG. 2.

If the starter switch is ON; that is, during engine starting, the value Ks determined according to the graph of FIG. 4 is used. If the idle switch is ON and the coolant temperature is above 10° C. under this condition, the value of the correction factor Ks is reduced in a manner similar to that described in connection with the correction factor Kw. If the starter switch is OFF; that is, after the end of cranking, the value of the correction factor Ks is reduced in accordance with the accumulated number of rotation of the engine. For example, the correction factor Ks may be reduced by a constant amount every five turns of rotation of the engine until the correction factor Ks reaches zero. Although the correction factor Ks may be reduced by a constant amount every turn of rotation of the engine, digital computers are difficult to subtract one-fifth of an integer from the data unlike subtracting an integer from the data.

The correction factor Kw and Ks are preferably changed to higher values at higher coolant temperatures. When the engine overheats or starts again in a short time after running, the fuel supply pipes are heated at high temperature and the air/fuel mixture is lean and percolated. As a result, the amount of fuel supplied to the engine becomes insufficient if the duration of fuel injection is held constant. To avoid such disadvantages, the correction factors Kw and Ks are set to higher values in the range where the engine coolant temperature is above 80° C. That is, the data may be organized on the table such as to increase at the side of high temperatures as shown in the graph of FIG. 4.

The correction factor Kr required in acceleration includes a correction factor Kr1 varying dependent on coolant temperature for improving the responsibility of the engine at low coolant temperature and a correction factor held constant regardless of coolant temperature for correction if overshooting occurs in the intake air flow meter. Acceleration may be detected with the use of the idle switch or any other suitable means. The correction factor Kd required in deceleration is for moderating shocks during deceleration and varies with coolant temperature.

Figure 8:
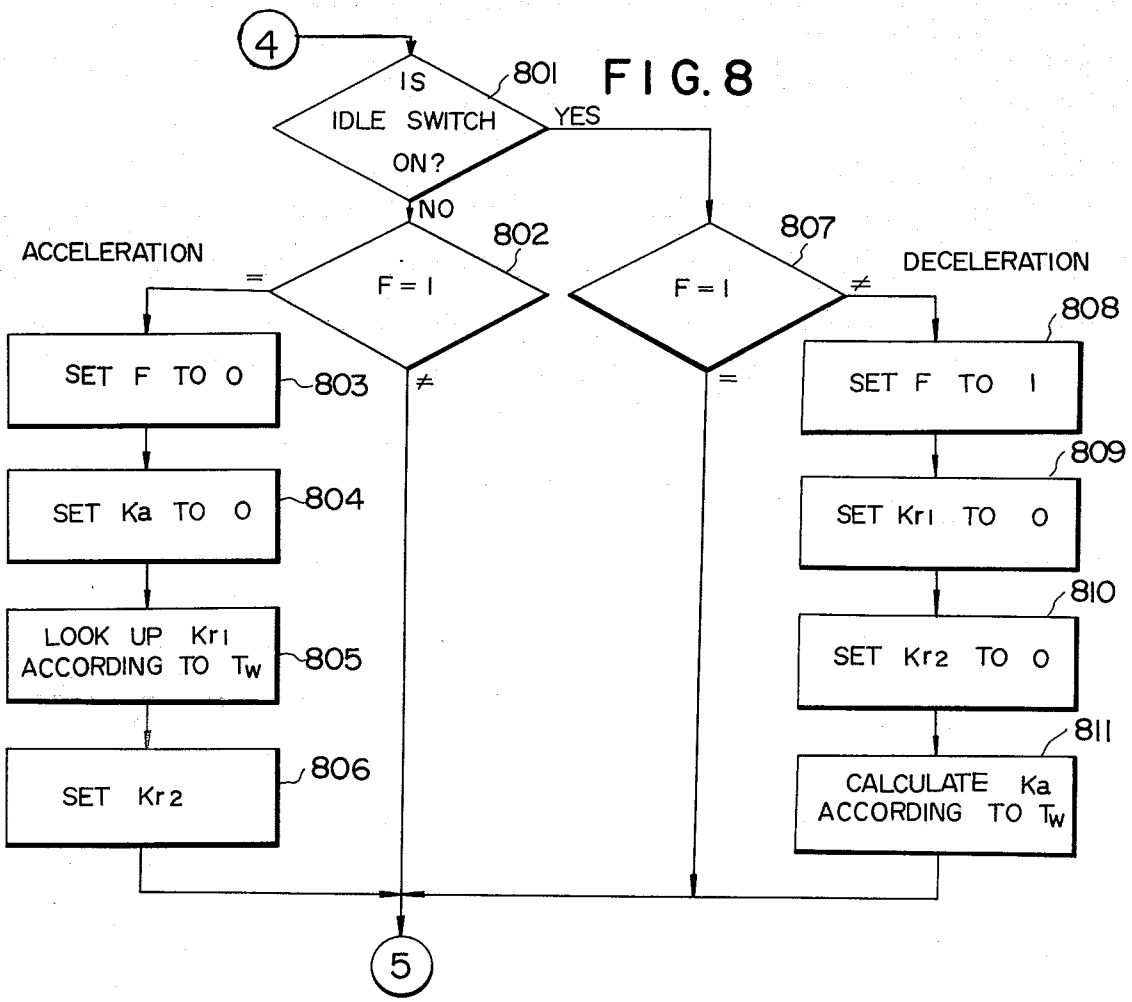

FIG. 8 is a flowchart showing the successive steps for determining the initial values of the correction factors Kr and Kd. The flowchart corresponds to the blocks 204 and 205 of FIG. 2 and is subsequent to the end of the program of FIG. 6. Although the correction factors Kr and Kd are determined sequentially in the program of FIG. 2, it is to be noted that the correction factors may be determined concurrently in the case illustrated where acceleration and deceleration are judged by a single idle switch. Of course, acceleration and deceleration may be judged sequentially if different means are used for detecting acceleration and deceleration.

Assuming now that acceleration is detected after idling or deceleration, the idling switch changes to its OFF state. After the OFF state of the idle switch is detected in a block 801, the program advance to a block 802 where the flag F is tested for 1; that is, whether or not the acceleration is the first. Since the flag F is 1 just after the idle switch is turned to its ON position, the flag F is made zero in a block 803 and subsequently the correction factor Kd is made zero in a block 804. This is due to the fact that the correction factor Kd is unnecessary during acceleration. The program is then advanced to a block 805 where the initial value of the first correction factor Kr1 is determined by looking up a table with respect to coolant temperature Tw. The initial value is positive and varies with coolant temperature. Subsequently, the program advances to a block 806 where the initial value of the second correction facor Kr2 is determined. The second correction factor Kr2 is for correction if overshooting occurs in the intake air flow meter. The initial value of the second correction factor Kr2 is a negative value held constant regardless of coolant temperature. If the program is carried out again, the flag F continues at zero and the block 802 is directly succeeded by the end of this program. As a result, the initial value is set only once just after the engine operating condition shifts to acceleration.

The idle switch is ON during deceleration and thus the block 801 is succeeded by a block 807. Since the flag F is zero at this time, the block 807 is succeeded by a block 808 where the flag F is made 1. In blocks 809 and 810, the correction factors Kr1 and Kr2 are made zero for the purpose similar to that described in connection with the correction factor required during acceleration. The program advances to a block 811 where the initial value of the correction factor Kd is determined. Although the initial value may be determined by a look-up technique, it can be easily obtained by a calculation due to the simple relationship between the correction factor Kd and coolant temperature. For example, the initial value of the correction factor Kd is set to a constant level (0) below a first predetermined low temperature, to a second constant level (0.5) above a second predetermined high temperature, and to a level proportional to the temperature between the first and second temperatures. If the program is carried out again during deceleration, the flag F is 1 so that the initial value is set only once. That is, the flag F is means for storing the fact that the initial value of the correction factor Kd has been set. The initial values set in the program are decreased or increased in accordance with the accumulated number of rotation of the engine until they reach zero.

Description will be made to the correction factor Kf required at high load conditions. It is well know that the air/fuel ratio of a mixture supplied to an engine should be modified depending upon various engine operations including engine load. In other wards, the air/fuel ratio required for an automotive vehicle running on a flat road is different from one required for an automotive vehicle running on an ascent or descent. The load conditions of an engine may be represented by the combination of the engine rotational speed N and the intake air flow rate Q or the intake air flow rate per rotation of the engine (Q/N=Tp). Thus, the correction factor Kf may be determined as a function of the speed of rotation of the engine and the basic pulse width Tp. For example, the correction factor Kf may be determined by looking up a two-dimentional table where data on correction factors Kf are originated with respect to N and Tp. Interpolation may be performed to determine a correction factor value not existing on the table.

An effective pulse width is determined by adding the determined correction factors and then multiplying the sum by the basic pulse width Tp. The following equation may be used to obtain an actual pulse with Ti:

$$Ti = Tp\cdot(1+Kw+Ks+Kr+Kd)\cdot Kc\cdot Kl+Ts$$

wherein Kc is the correction factor required if fuel-cut is made during deceleration, Kl is the correction factor depending upon a control signal from an exhaust gas sensor, and Ts is the correction factor for a delay with which the fuel injection value means operates due to the voltage of the power supply and is given by an equation $Ts=a-b\cdot Vb$ where a and b are constants and Vb is the voltage of the battery.

Although the present invention has been described as varying the correction factors Ks, Kr and Kd with rotation of the engine, it is to be noted that they may be varied with time, in which case, at least part of the program III-IV of FIG. 2 may be carried out at an interval of a constant time. In either case, it is possible to separate the program for determining correction factor initial values from the program carried out with time. This is effective to simplify the programs. If the program I-II is carried out with rotation of the engine or with time, it may proceed to the program III-IV. Since variations in engine operating condition occur with rotation of the engine, varying the correction factors with rotation of the engine is more advantageous than varying them with time.

In some instances, it can match with variations in engine operating conditions to varying the correction factors with intake air flow rate. For this purpose, the correction factors may be varied with rotation of the engine by an amount proportional to the basic pulse width Tp; that is, to the intake air flow rate, or by an amount proportional to the actual pulse width Ti or the actual pulse width Ti minus the correction factor Ts; that is, to the amount of fuel supplied to the engine. For this purpose, the correction factors may be varied by an amount proportional to the pulse width each time the engine rotates a turn. In fuel supply systems adapted to inject fuel at an interval of a constant time, or inject fuel several times at an interval of a constant time, the correction factors may be varied in each cycle of fuel injection to match them with engine operating conditions. In fuel supply systems adapted to continuously inject fuel, the correction factors may be varied at an interval of a constant time.

The equation used to obtain the correction coefficient is not limited to 1+Kw+Ks+Kr+Kd+Kf and the term (1−Kw) may be another factor. In addition, it is not necessary for the equation to include all of the correction factors. For example, the correction factor Kf may be removed and multiplied by the whole equation. Furthermore, other suitable correction factor such for example as a correction factor variable depending upon the temperature of intake air or a correction factor variable depending upon air density.

In automotive vehicles installed with an automatic transmission, shock occuring during deceleration is small and the correction factor Kd is unnecessary. Thus, the program for determining the correction factor Kd may not be carried out for such automotive vehicles. Since some of the correction factors are dependent upon the type of automotive vehicles, it is desirable to selectively use one of a plurality of data units according to the type of automotive vehicles.

The basic pulse width Tp may be calculated from the intake air flow rate Q, the combination of the intake manifold vacuum and the engine rotation, or the combination of the throttle opening and the engine rotation other than from the engine rotation N and the reciprocal 1/Q of the intake air flow rate Q as previously stated. In addition, the speed of rotation of the engine may be detected from the period of the synchronous pulse other than from the number of engine rotation indicative pulses in a constant period of time.

Although the temperature of engine coolant is used to represent the engine temperature, correction may be made in accordance with the temperature of oil in an air-cooled engine, the temperature of the engine body, the temperature of the inner wall of the combustion chamber, or the like.

There has been provided, in accordance with the present invention, an improved fuel supply control system with a fast response to variations in engine operating condition so as to improve engine performance and fuel economy. While this invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. In a fuel supply control system for use in an internal combustion engine, said system using a stored program type digital computer for calculating a basic amount of fuel and said system modifying the basic amount of fuel in accordance with various correction factors dependent upon engine operating conditions so as to determine an actual amount of fuel to be supplied to the engine, an improvement in the fuel supply control system comprising:

means for summing all correction factors dependent upon engine temperature; and means for multiplying the sum of said correction factors by said basic amount of fuel so as to determine said actual amount of fuel, said fuel supply control system further including means for increasing or decreasing each of said correction factors by a value proportional to the amount of fuel supplied to the engine or the intake air flow rate.

2. A fuel supply control system according to claim 1, wherein the initial value of said correction factor is not set again after it is once set.

3. In a fuel supply control system for use in an internal combustion engine, using a stored program type digital computer for calculating a basic amount of fuel and modifying the basic amount in accordance with various correction factors dependent upon engine operating conditions so as to determine an actual amount of fuel supplied to the engine, said fuel supply control system characterized in adding all correction factors dependent upon engine temperature and then multiplying the sum by the basic fuel amount so as to determine the actual fuel amount, providing at least one of upper and lower limits to the basic fuel amount, and varying at least one of the upper and lower limits in accordance with the type of automotive vehicles.

4. A fuel supply control system according to claim 3, wherein the type of automotive vehicle is detected depending upon whether the automotive vehicle is installed with an automatic transmission or an manual transmission.

5. A fuel supply control system according to claim 1, wherein the basic amount of fuel is calculated by multiplying the speed of rotation of the engine and the reciprocal of the intake air flow rate and then dividing a constant by the product.

6. A fuel supply control system according to claim 5, wherein one of the reciprocal of the intake air flow rate, the product of the speed of rotation of the engine and the reciprocal of the intake air flow rate, and the basic amount of fuel has at least one of upper and lower limits.

7. A method of controlling fuel supplied to an internal combustion engine, wherein said engine includes a fuel supply control system using a stored program type digital computer for calculating a basic amount of fuel and said system modifying the basic amount of fuel in accordance with various correction factors dependent upon engine operating conditions so as to provide an actual amount of fuel to be supplied to the engine, said improved method comprising the steps of:

summing all correction factors dependent upon engine temperature;

increasing or decreasing each of said correction factors by a value proportional to the amount of fuel supplied to the engine or the intake air flow rate; and multiplying the sum of said correction factors by said basic amount of fuel so as to determine said actual amount of fuel.

* * * * *